US009972894B2

(12) United States Patent
Dion et al.

(10) Patent No.: US 9,972,894 B2
(45) Date of Patent: May 15, 2018

(54) WEARABLE POWER HARVESTING SYSTEM

(71) Applicant: Drexel University, Philadelphia, PA (US)

(72) Inventors: Genevieve Dion, Philadelphia, PA (US); Kapil R. Dandekar, Philadelphia, PA (US); Yury Gogotsi, Ivyland, PA (US); Damiano Patron, Philadelphia, PA (US); Kristy A. Jost, Philadelphia, PA (US); Michael N. Le, North Wales, PA (US); Jonathan W. Fisher, Medford, NJ (US); Stephen J. Watt, Norristown, PA (US); Andrea C. Cook, Philadelphia, PA (US)

(73) Assignee: Drexel University, Philadelphia, PA (US)

( * ) Notice: Subject to any disclaimer, the term of this patent is extended or adjusted under 35 U.S.C. 154(b) by 451 days.

(21) Appl. No.: 14/643,715

(22) Filed: Mar. 10, 2015

(65) Prior Publication Data

US 2016/0261031 A1 Sep. 8, 2016

Related U.S. Application Data

(60) Provisional application No. 61/950,472, filed on Mar. 10, 2014, provisional application No. 62/005,531, filed on May 30, 2014.

(51) Int. Cl.

| | |
|---|---|
| ***H01Q 1/27*** | (2006.01) |
| ***H01Q 9/26*** | (2006.01) |
| ***H01Q 1/24*** | (2006.01) |

(52) U.S. Cl.
CPC ..... *H01Q 1/248* (2013.01); *H01Q 1/273* (2013.01); *H01Q 9/26* (2013.01)

(58) Field of Classification Search
CPC ..... H01Q 1/248; H01Q 1/273; H01Q 9/26
See application file for complete search history.

(56) References Cited

U.S. PATENT DOCUMENTS

| | | | | |
|---|---|---|---|---|
| 6,356,238 | B1 * | 3/2002 | Gainor | H01Q 1/273 343/718 |
| 6,727,197 | B1 * | 4/2004 | Wilson | G06K 19/041 174/117 F |
| 7,486,252 | B2 * | 2/2009 | Hiltmann | G06K 19/027 343/895 |
| 7,511,621 | B1 * | 3/2009 | Duan | G06K 7/0008 340/572.1 |
| 8,847,824 | B2 * | 9/2014 | Kotter | H01Q 1/248 343/700 MS |

(Continued)

*Primary Examiner* — Dameon E Levi
*Assistant Examiner* — Jennifer F Hu
(74) *Attorney, Agent, or Firm* — Baker & Hostetler, LLP

(57) ABSTRACT

A wearable power harvesting system includes a knitted fabric rectenna including an antenna adapted to receive radio-frequency energy within a desired frequency band and a rectifier circuit that converts received radio-frequency energy into a DC current and voltage. A knitted fabric load/storage unit stores DC power from the rectifier circuit. The power harvesting system is adapted to harvest the radio-frequency energy within the desired frequency band, which may include WLAN frequencies such as the standard 2.4 GHz and 5 GHz WLAN standard frequencies.

13 Claims, 22 Drawing Sheets

(56) References Cited

U.S. PATENT DOCUMENTS

| | | | | |
|---|---|---|---|---|
| 2003/0003359 | A1* | 1/2003 | Banno | H01G 9/038 429/189 |
| 2003/0011528 | A1* | 1/2003 | Marchand | H01Q 1/248 343/793 |
| 2003/0160732 | A1* | 8/2003 | Van Heerden | G06K 19/027 343/897 |
| 2007/0087719 | A1* | 4/2007 | Mandal | H01Q 1/22 455/299 |
| 2007/0251207 | A1* | 11/2007 | Stobbe | G06K 19/02 57/218 |
| 2008/0055092 | A1* | 3/2008 | Burr | G06K 19/0707 340/572.7 |
| 2008/0287022 | A1* | 11/2008 | Dhawan | D02G 3/38 442/229 |
| 2009/0018428 | A1* | 1/2009 | Dias | A41D 13/1281 600/388 |
| 2009/0295657 | A1* | 12/2009 | Gakhar | A41D 13/1281 343/718 |
| 2009/0311587 | A1* | 12/2009 | Best | H01M 4/74 429/127 |
| 2010/0051699 | A1* | 3/2010 | Speich | D06H 1/04 235/492 |
| 2012/0224247 | A1* | 9/2012 | Sotzing | H01M 4/02 359/265 |
| 2013/0249771 | A1* | 9/2013 | Kotter | H01Q 1/248 343/893 |
| 2013/0345695 | A1* | 12/2013 | McPherson | H02J 50/40 606/34 |

* cited by examiner

| Stretch Amount | Gain (dBi) |
|---|---|
| Nominal | 1.88 |
| +5mm | 2.04 |
| +10mm | 2.53 |

FIG. 8

| | Commercial | Textile |
|---|---|---|
| Capacitance (mF) | 100 | 1 |
| Applied Voltage (mV) | 200 | 200 |
| Charged Voltage (mV) | 200 | 140 |
| Charge Time | ~10 sec | ~5 min |

| | Rectenna Prototype 1 | Rectenna Prototype 2 | Rectenna Prototype 3 |
|---|---|---|---|
| DC Voltage | 2.60 mV | 16.0 mV | 200 mV |
| DC Power | 13.5 nW | 500 nW | 80.0 $\mu$W |
| Conversion Efficiency ($\eta$) | 0.0003 % | 0.01 % | 1.58 % |

| Method | Gain (dBi) |
|---|---|
| Baseline | 3.71 |
| Compression | 0.61 |
| Clasp | 2.72 |
| Silver Paint and Epoxy | 0.97 |
| Conductive yarns | 2.42 |

WEARABLE POWER HARVESTING SYSTEM

CROSS REFERENCE TO RELATED APPLICATIONS

This application claims the benefit of U.S. Provisional Patent Application Ser. No. 61/950,472 filed Mar. 10, 2014, and of U.S. Provisional Patent Application Ser. No. 62/005,531 filed May 30, 2014, the disclosures of which are hereby incorporated by reference as if set forth in their entireties herein.

TECHNICAL FIELD

The invention relates to smart knitted fabrics and the use of such fabrics as a wearable power harvesting system.

BACKGROUND

Work on wearable electronics has been ongoing for many years now, and in recent years some textile and wearable electronics devices have been introduced on the market. Examples include the Nike Fit, Adidas MiCoach, Hi-Call Bluetooth "Phone-Glove" and soon to be available Google Glass and the Apple Smartwatch. Conductive yarns and fabrics are commercially available, and can be coated or made entirely of metals or conductive carbons. However, textile energy storage and harvesting systems are still under development.

Energy harvesting systems include piezo-electric materials that produce electrical energy from body movements, wearable solar panels, thermoelectrics that could collect energy from body heat, or wireless Wi-Fi energy harvesting. Wireless harvesting poses advantages over other technologies, as it is ambient and does not require the wearer to be moving or specifically outside, and today most people are surrounded by Wi-Fi and broadband signals both at home and work. Thus, most people will be constantly charging their smart clothes.

Additionally, pairing these systems with energy storage (i.e., batteries or supercapacitors), means extra energy can be collected and stored for later use. A variety of combined energy harvesting and storage systems have been proposed, including tribo-electric systems with batteries as coin cells and flexible fibers that can act as both a solar cell and supercapacitor as illustrated in FIG. 1. FIG. 1 illustrates conventional hybrid energy storage and energy generation devices. FIG. 1(*a*) illustrates a fiber supercapacitor combined with a tribo-electric generator adapted to store and harvest energy from body movements. FIG. 1(*b*) illustrates a generator and supercapacitor that are powerful enough to light an LED. FIG. 1(*c*) illustrates a current/voltage curve of a single supercapacitor tested at 200 mV/s in a PVA-$H_3PO_4$ electrolyte. FIG. 1(*d*) illustrates a combined solar cell and pseudocapacitive fiber in liquid electrolytes. FIG. 1(*e*) illustrates a current/voltage curve of the supercapacitor tested at 0.5 V/s in 1M PVA-$H_3PO_4$ gel electrolyte and at different lengths. However, to date, no full fabric solutions with all of the integrated circuitry have been proposed.

The three main electrochemical energy storing technologies used in wearable systems (ranging from high power to high energy respectively) include electrical double layer capacitors (EDLCs), pseudocapacitors, and batteries. Both double layer and pseudocapacitors are commonly called "supercapacitors." All of these devices typically consist of an electrode material, current collector, separator and electrolyte. FIG. 2 illustrates basic schematics for an a) all carbon EDLC (left), b) a pseudocapacitor ($MnO_2$ depicted in center) and c) a lithium ion battery (right). All devices have an active material (e.g., carbon, $MnO_2$, $LiCoO_2$), a current collector, a separating membrane and an electrolyte (e.g., $Na_2SO_4$, or $LiPF_6$ solutions). As shown in FIG. 2(*a*), EDLCs store charge in an electrostatic double layer between the surface of a charged electrode material and its respective counter ions. As shown in FIG. 2(*c*), batteries store charge through the conversion of chemical energy into electrical energy. Rechargeable secondary batteries use reactions that are reversible (e.g., lithium ion intercalation into graphite). As shown in FIG. 2(*b*), pseudocapacitors are devices that have both a double layer capacitance and fast surface redox or intercalation, which increases the energy density while maintaining fast charge and discharge times comparable to an EDLC.

Typical tests conducted to measure the capacitance and resistance in energy storage devices are cyclic voltammetry (CV), galvanostatic cycling (GC), and electrochemical impedance spectroscopy (EIS). Usually capacitance can be determined from CV and GC, and the equivalent series resistance (ESR) can be determined from GC and EIS.

Energy storing textiles can be categorized into 3 main groups: coated energy textiles, fiber and yarn electrodes, and custom woven and knitted textiles. Researchers began by coating pre-existing cotton or polyester textiles, either woven, knitted or non-woven, with various carbon or redox active electrode materials. Dip-coating, screen-printing, and painting were used to incorporate these materials into the fabric. However, multiple manufacturing challenges will need to be overcome for coated full fabrics as multiple layers of current collector, electrode, separator and encasement have to be incorporated into a single piece of fabric or a multi-layered garment.

The first reports of yarn or fiber-like supercapacitors and batteries came out between in 2011 and 2012. These planar materials could be transformed into 2-D and 3-D fabrics. From these reports, only a few groups report making their own woven or knitted textiles. The many reported textile supercapacitors which were tested at or around 0.2 A/g and 10 mV/s, the standard operating rates for conventional supercapacitors, are compared and contrasted below.

Capacitive fibers are the most promising materials for energy storing textiles because they can be knitted, woven or stitched into a fabric. If one knows the capacitance per length of the fiber/yarn, one can subsequently design a fabric with a specified total capacitance and resistance. Some examples of flexible energy storing fiber/yarn capacitors are shown in FIG. 3. The left column of FIG. 3 provides a schematic of a fiber yarn device, while the center column of FIG. 3 provides electrochemical data. The right column of FIG. 3 provides micrographs of real material. FIG. 3(*a*) illustrates a fiber supercapacitor encased in plastic tubing. FIG. 3(*b*) illustrates the resulting cyclic voltammogram tested at 1 V/s, while FIG. 3(*c*) illustrates an SEM image of the surface morphology of the graphite electrode material. FIG. 3(*d*) illustrates graphene fiber (GF) coated in polyelectrolyte. FIG. 3(*e*) illustrates the resulting cyclic voltammogram tested at 50 mV/s, while FIG. 3(*f*) illustrates an SEM image of the fiber cross section. FIG. 3(*g*) illustrates Bis-crolled CNT-PEDOT fiber, and FIG. 3(*h*) illustrates the resulting cyclic voltammograms tested at 1V/s. FIG. 3(*i*) illustrates an SEM image of the fiber cross section, while FIG. 3(*j*) illustrates CNT coated cotton fiber with additional layers of Ppy and $MnO_2$ encased in a plastic tube. FIG. 3(*k*) illustrates the resulting cyclic voltammograms, and FIG. 3(*l*)

illustrates an SEM image of the fiber surface. FIG. 3(*m*) illustrates a schematic of a coaxial style lithium battery cable, while FIG. 3(*n*) illustrates the resulting charge-discharge curves, and FIG. 3(*o*) illustrates an optical micrograph of the cross-section.

A variety of textile supercapacitors have appeared in the scientific literature since 2009, including cotton or polyester textiles that have been coated in capacitive materials, fibers and yarns made entirely of capacitive materials, or full fabrics that incorporate all of the components of supercapacitors. However, the functionality of such devices is severely limited.

Also, with recent advancements in wireless communication, ultra-low-power electronics, and wearable technology, a new class of data networks has emerged for applications in which sensors are worn on the human body. A body sensor network (BSN), also known as a body area network (BAN), is a wireless system of low-power devices worn on or in the immediate proximity of the human body, capable of monitoring physiological functions or conditions in the surrounding environment. Body sensor networks have practical applications in a variety of industries including healthcare, entertainment, athletics, interactive gaming, consumer electronics, and the military. Body sensor networks (BSN) currently employ devices that are powered by battery sources, which pose a number of environmental and sustainability issues.

The field of body area networks evolved from technological advances in low-power integrated circuits and wireless communication, as well as a number of disadvantages presented by older technologies. For example, conventional electronics worn on the body are known to cause a great deal of discomfort to the user due to their rigidity and inability to conform to the contour of human anatomy. Additionally, many traditional biological sensors are powered using standard outlet and battery sources. Outlet power tethers the user and restricts movement, limiting the technology to mostly stationary applications. Battery sources present environmental issues due to waste created by their disposal.

In the healthcare industry, a preliminary study (published in November 2010) is being conducted at the Cardiology Unit of La Paz Hospital in Madrid, Spain to evaluate the combination of e-textiles and sensor devices for patient monitoring. This system utilizes two knit electrodes to measure bioelectric potential in the body, an accelerometer to measure patient movement, and thermometer to measure body temperature. The sensors and battery power source are enclosed in a case the size of a cassette tape. The battery occupies roughly 25% of this enclosure.

It is desired to develop an energy harvesting system on a textile substrate to wirelessly power body area network devices and eliminate the need for conventional batteries. Energy harvesting is a process in which energy collected from external sources, which can then be stored and converted into electrical energy. In radio-frequency applications, the source of harvested energy is electromagnetic radiation present in the ambient atmosphere or transmitted from an intentional radiator. If an intentional radiator is used, it must follow FCC regulations for maximum power radiated. Utilizing alternative energy sources will ensure that the system is sustainable and that operation will produce minimal negative impact on the environment as compared to solely battery powered devices.

It is particularly desired in accordance with the invention to develop an energy harvesting antenna and supercapacitor that are knitted within the same piece of fabric with little post production processing to produce electronic textiles that enable wireless and autonomous powering of body-worn sensors without the limitations of the prior art. The present invention addresses these and other needs in the art.

SUMMARY

The invention addresses the above-mentioned needs in the art by providing a system for harvesting power from the ubiquitous Wireless Local Area Networks (WLAN) that surround us every day. While the design can be scaled and tuned to harvest power from other radio regions (satellite communications, cell phone channels, etc.), the exemplary embodiment is a wearable power harvesting system for WLAN frequencies. By conducting a wireless power survey, it has been shown that WLAN networks can provide a more frequent and stable source of radio energy. Since current WLAN standards use the frequency regions of 2.4 GHz and 5 GHz, the wearable power harvesting system described herein is designed to operate at the 2.4 GHz band, but it can be easily scaled to operate within the 5 GHz band as well.

The objective of the system described herein is to realize a low cost, textile-based power harvesting system for the 2.4 GHz WLAN band for integration into clothing. In contrast with previous wearable power harvesting systems, the inventors manufacture this technology by using conductive and non-conductive yarns through conventional knitting machines without the need of sewing or gluing conductive parts. In the system described herein, even the storage unit is made by a knitted supercapacitor, which results in a fully knitted power harvesting system.

The energy harvesting system of the invention includes a textile antenna, supporting circuitry, and a textile supercapacitor integrated on a single piece of fabric. The supporting circuitry provides impedance matching, rectification, filtering, and is implemented on a small printed circuit board (PCB) that is connected to the fabric using drill holes and a clasp. The design demonstrates a rectified voltage of 260 mV using a dedicated transmitter supplying a 100 mW signal at 2.45 GHz from a distance of 40 centimeters. The 1 mF textile supercapacitor was charged to 80 mV in approximately 15 minutes. The form factor of the system is 56 $cm^2$, making it small enough to fit on the upper back of a garment.

In exemplary embodiments, the wearable power harvesting system of the invention includes a knitted fabric rectenna including an antenna adapted to receive radio-frequency energy within a desired frequency band (e.g., 2.4 GHz or 5 GHz) and a rectifier circuit that converts received radio-frequency energy into a DC current and voltage, and a knitted fabric load/storage unit such as a knitted supercapacitor that stores DC power from said rectifier circuit. In exemplary configurations, the antenna comprises a compact wideband folded dipole antenna having a single layer and including a non-conductive fabric surrounded by a conductive fabric. In an exemplary configuration, the non-conductive fabric forms a "T-shape" within the conductive fabric. Alternatively, the rectenna may also include a shorting capacitor and rectifying diode to transfer power to the supercapacitor.

The inventive power harvesting system may also include a knitted pocket that stores circuitry including a Schottky diode and surface-mount inductance (L) and capacitance (C) components that match an impedance of the antenna to the Schottky diode. The circuitry may be connected to the knitted fabric by a liquid epoxy adapted to provide an electrical connection between the circuitry and the fabric. Alternatively, the circuitry may contain tabs that extend into pockets of the conductive fabric to provide a compression fit, or a clasp may be used that it adapted to hold the conductive elements of the circuitry in contact with the conductive fabric. Additionally, conductive yarn may be threaded through a circuit board containing the circuitry so as to connect the circuit board to the fabric.

In order to increase the amount of harvested power, the a plurality of rectennas may be cascaded to add up their respective energy contributions and the resulting DC power output of each rectenna combined for storage in the load/storage unit. In the resulting array, each rectenna is spaced from each other rectenna so as to achieve a directive radiation pattern and to substantially eliminate coupling between each rectenna.

BRIEF DESCRIPTION OF THE DRAWINGS

The foregoing and other beneficial features and advantages of the invention will become apparent from the following detailed description in connection with the attached figures, of which:

FIG. 8 illustrates the gain of the stretched knitted antennas.

DETAILED DESCRIPTION OF ILLUSTRATIVE EMBODIMENTS

The present invention may be understood more readily by reference to the following detailed description taken in connection with the accompanying figures and examples, which form a part of this disclosure. It is to be understood that this invention is not limited to the specific products, methods, conditions or parameters described and/or shown herein, and that the terminology used herein is for the purpose of describing particular embodiments by way of example only and is not intended to be limiting of any claimed invention. Similarly, any description as to a possible mechanism or mode of action or reason for improvement is meant to be illustrative only, and the invention herein is not to be constrained by the correctness or incorrectness of any such suggested mechanism or mode of action or reason for improvement. Throughout this text, it is recognized that the descriptions refer both to methods and software for implementing such methods.

A detailed description of illustrative embodiments of the present invention will now be described with reference to FIGS. 4-22. Although this description provides a detailed example of possible implementations of the present invention, it should be noted that these details are intended to be exemplary and in no way delimit the scope of the invention.

The invention incorporates designs for creating a wearable power harvesting system from knitted fabrics and for other knitted electrical components used for energy storage that are embedded within the same sheet of fabric during manufacturing. Embodiments of such systems will be described below.

Power Harvesting System

Figure 1:
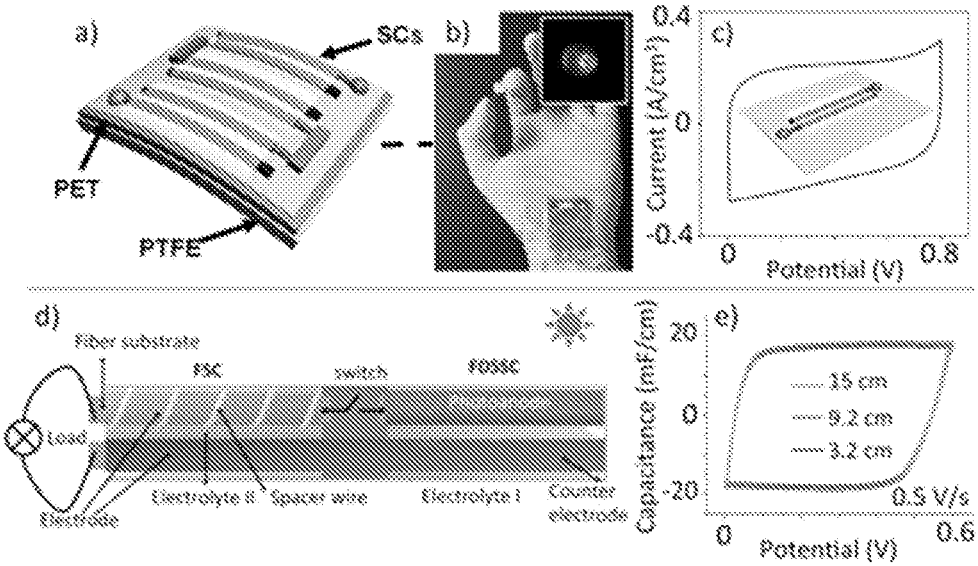
FIG. 1 (PRIOR ART)
FIG. 1 illustrates conventional hybrid energy storage and energy generation devices.
Figure 2:
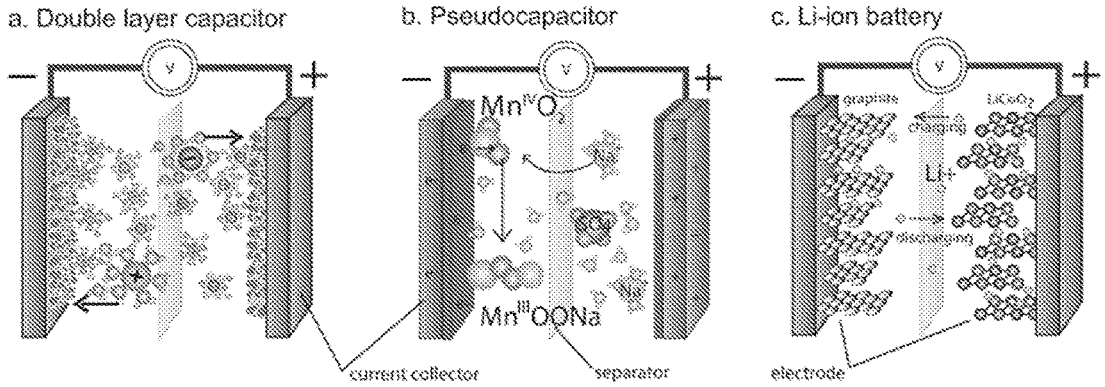
FIG. 2 (PRIOR ART)
FIG. 2 illustrates basic schematics for a conventional a) all carbon electrical double layer capacitor (EDLC) (left), b) pseudocapacitor (center), and c) lithium ion battery (right).
Figure 3:
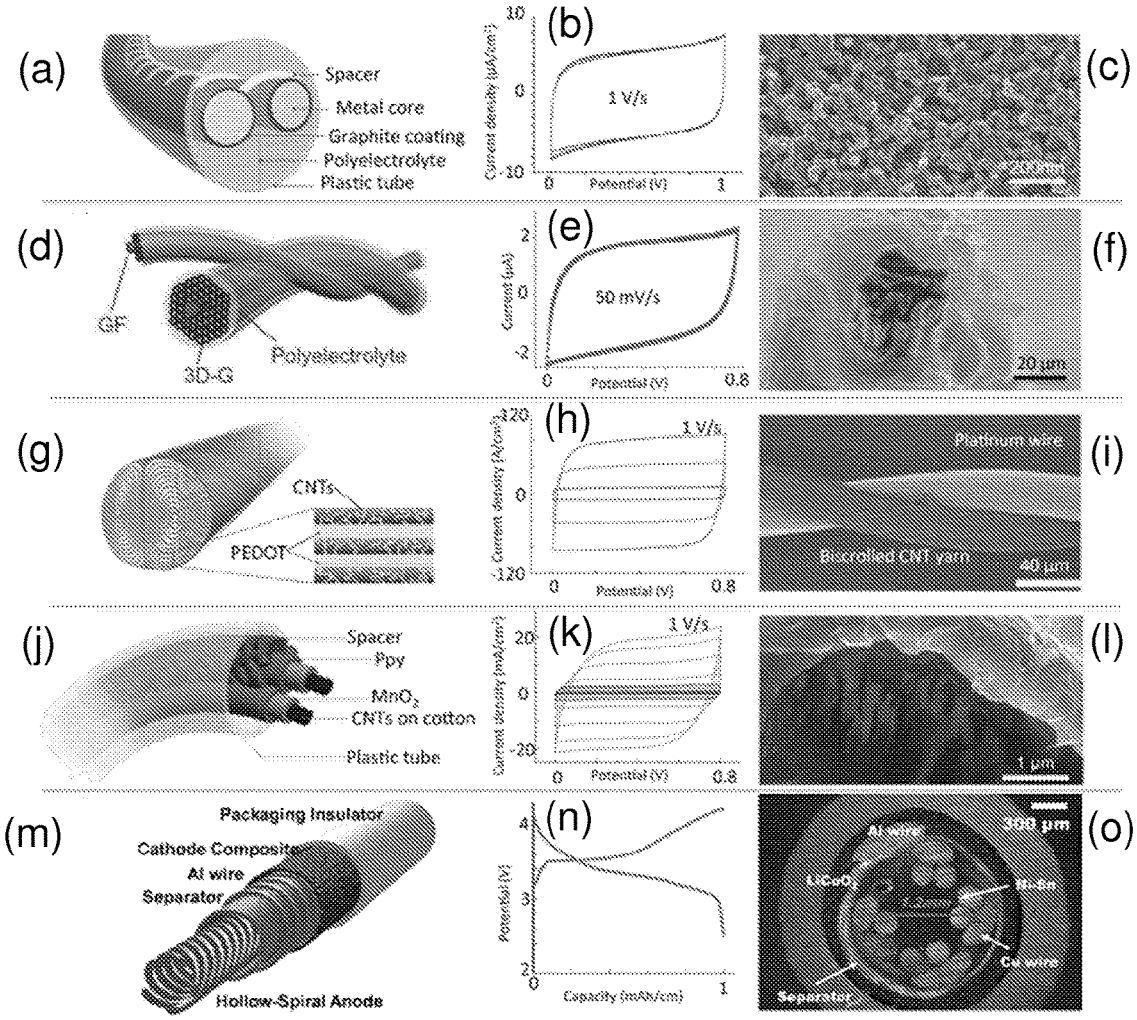
FIG. 3 (PRIOR ART)
FIG. 3 illustrates various conventional flexible energy storing fibers/yarns.
Figure 4:
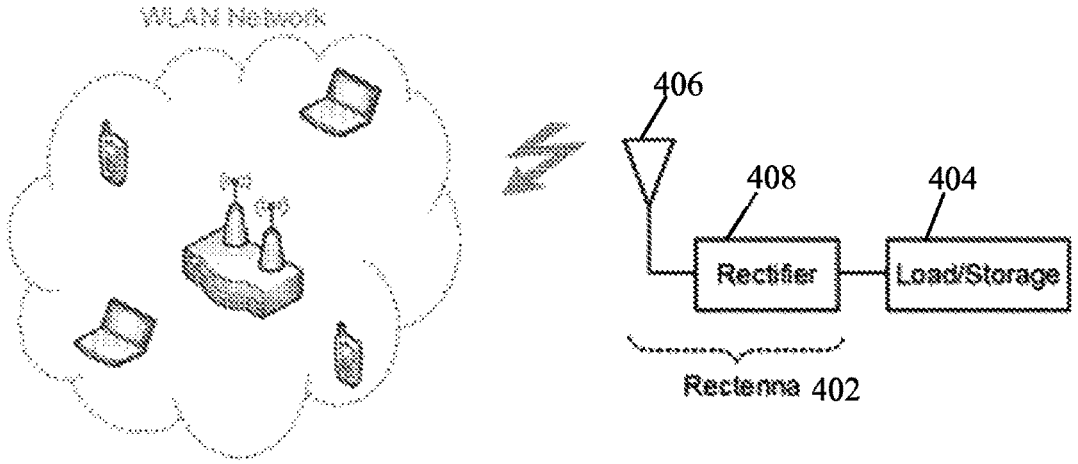
FIG. 4 illustrates a block diagram of the inventive system including a rectenna along with a load/storage unit that are manufactured from textiles.

As shown in FIG. 4, the power harvesting system of the invention includes two main units, the rectenna 402 and the load/storage unit 404. The rectenna comprises the actual antenna 406 responsible for harvesting the radio-frequency energy within the desired frequency band. The rectenna also includes a rectifier circuit 408 that converts the harvested radio-frequency signal into a DC current and voltage. The harvested DC power is then transferred to a load or storage unit 404 (such as supercapacitor or battery) for future discharging.

The antenna is first designed and simulated using a high frequency software simulator. The layout of the antenna can be realized in single or multiple planar layers. Next, the design is converted in a 2D CAD model for driving knitting machines. The actual antenna metallization is manufactured using conductive yarns while the non-conductive yarns will constitute the remaining part of the garment serving as support for the conductive antenna layout.

Power Harvesting Principle (Friis Equation)

Nowadays, radio-frequency (RF) power sources surround us very day both in indoor and outdoor environments. Examples of RF energy source are radio transceivers, wireless access points (WLAN networks), repeaters, and handheld devices. By considering a wireless link between a transmitter (RF source) and a receiver (rectenna), there are multiple parameters that determine the amount of received power from the receiver. The power transfer can be calculated through the Friis Equation:

$$P_r = P_t G_t G_r \left(\frac{\lambda}{4\pi R}\right)^2$$

where, $P_r$ is the received power, $P_t$ transmitted power, $G_t$ transmitter gain, $G_r$ receiver gain, $\lambda$ frequency wavelength, and R the distance between transmitter and receiver.

The power required for communications depends on applications and receiver sensitivity. Typically, the level required to wake up a receiver is the order of −70/−15 dBm. However, for harvesting RF energy, the power level should be sufficient to generate an appreciable current flow at the load/storage side and it can be achieved for RF power levels above −25/−20 dBm. Naturally, a closer proximity of the rectenna with the radio source will result in a higher exposure to RF energy with consequent increase of the generated DC power.

Antenna Design

Figure 5:
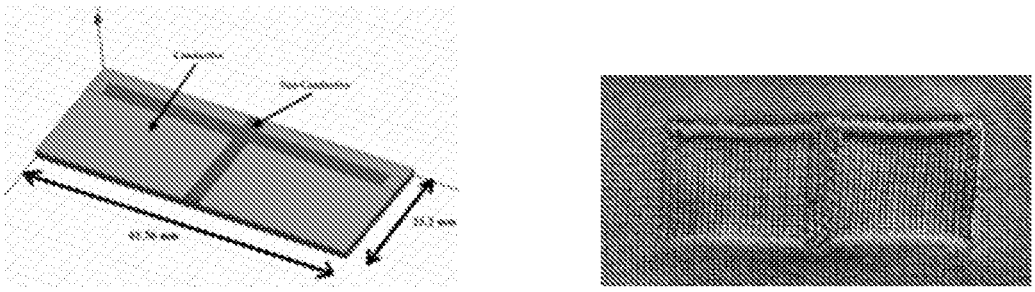
FIG. 5 illustrates a 3D CAD view of the antenna design and fabric prototype for the system of FIG. 4.

The radiator used for the rectenna is a compact wideband folded dipole antenna. As shown in FIG. 5, the antenna layout is characterized by a single layer and consists of a non-conductive fabric surrounded by the conductive fabric geometry. In the embodiment of FIG. 5, the non-conductive fabric forms a "T-shape" within the conductive part. The design is characterized by having a self-balancing behavior, which allows for direct input impedance measurements using the 50Ω vector network analyzer ports. A folded dipole design is also desirable due to its simple geometry, planar form, and wide bandwidth.

The design shown in FIG. 5 was simulated by considering the actual dielectric and conductivity characteristics of the employed yarns. Dimensions were tuned to achieve resonance at the center frequency of 2.45 GHz. The antenna size is thus small enough to fit on a garment yet large enough to meet knitting equipment constraints (feature sizes>3 mm). The measured prototype exhibits a bandwidth of about 1 GHz, covering with good impedance matching from 2 GHz to 3 GHz. This large frequency bandwidth allows power to be harvested from Wi-Fi as well as WiMAX networks. The aforementioned design was selected because it is characterized by a self-balancing structure and by a simple and single layer layout, which allows for convenient knitting manufacturing. Additionally, the omnidirectional radiation pattern, typical of this antenna topology, enables to harvest power from the whole surrounding space.

Figure 6:
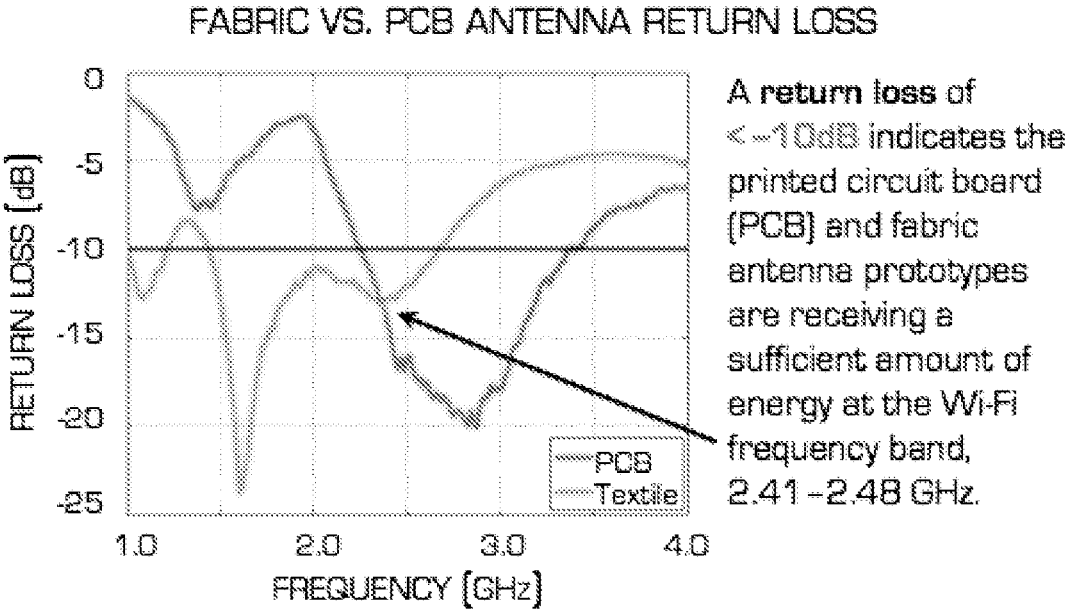
FIG. 6 illustrates return loss plots of a PCB rectenna versus a knitted antenna indicating that the textile antenna and fabric antenna are receiving a sufficient amount of energy at the Wi-Fi frequency band, 2.41-2.48 GHz.

FIG. 6 illustrates return loss plots of a PCB rectenna and a knitted antenna, where the textile antenna is shifted from the PCB, but has sufficient losses below −10 dB at 2.4 GHz indicating that more than 90% of the input power is being radiated. Inversely, this means that the antenna can efficiently absorb energy from Wi-Fi at this frequency.

Stretch Testing

Figure 7:
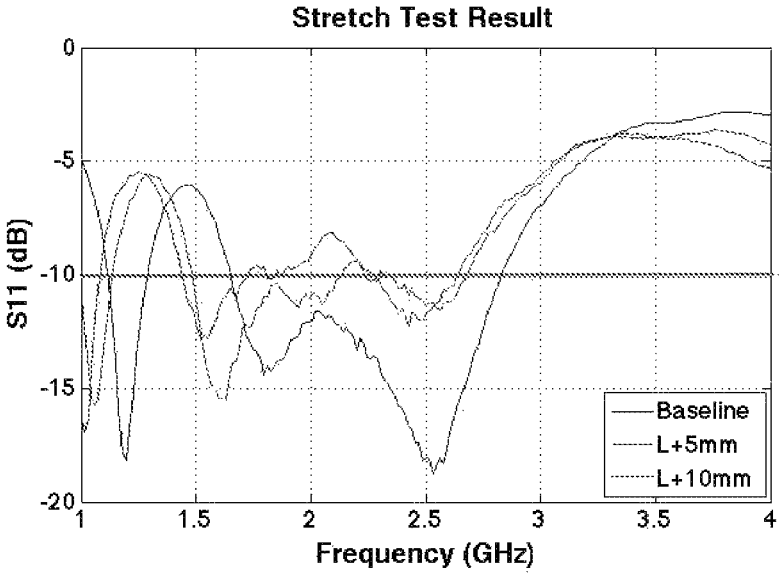
FIG. 7 illustrates a return loss plot of a knitted rectenna stretched 5 mm and 10 mm as compared to unstretched (baseline).

Stretch testing was done since stretching of the antenna is expected in a wearable application. FIG. 7 illustrates a return loss plot of a knitted rectenna stretched 5 mm and 10 mm as compared to unstretched (baseline). As expected, the elongation of the fabric antenna structure shifts the resonance lower in frequency, but it also increases the magnitude of the return loss (shown as an upward shifting of the curves). At 10 mm stretching for the experimental results, it can be seen that the return loss begins to increase above −10 dB for the 2.4 GHz Wi-Fi band. For this reason it is suggested that the folded dipole fabric antenna design be constrained to operating conditions where elongation is no more than 10 mm from the intended length.

Nonetheless, stretching within range still allows for acceptable operation of the antenna for up to 15% elongation, making it suitable for wearable applications. For future textile antenna design efforts, a custom fabric can be used that will keep the fabric relatively inelastic. The antenna can also be placed on a region of the body where stretching will not likely exceed 10 mm, such as the upper back of a garment.

FIG. 8 illustrates the gain of the stretched knitted antennas. As expected, the elongation of the fabric antenna increases the gain of the antenna but keeps the same radiation pattern.

Testing of a Knitted Supercapacitor

Knitted supercapacitors were fabricated in an interdigitated geometry in a single sheet of fabric. The textile supercapacitor components were as follows: 1) the current collector is a commercially available stainless steel yarn, (Beakart, Germany); 2) the electrode is made of a conductive high surface area material, (such as activated carbon, carbon nanotubes, graphene or graphite a conducting polymer, or oxide material) and, in an exemplary embodiment, the current collecting steel yarn has sufficient surface area to store the charge collected by the harvesting antennas; 3) the separator to electrically insulate the electrodes/current collectors from each other, is just nonconductive yarns knitted between the conductive layers; 4) the electrolyte is a polymer gel that is coated onto the steel yarn either pre- or post-knitting and is composed of Polyvinyl alcohol (PVA), phosphoric acid (H3PO4), water and silicotungstic acid. The polymer is applied and heat treated at 90° C. for 20 minutes to solidify. Other commonly used polymer electrolytes only use PVA, $H_3PO_4$ and water of different ratios.

Figure 9:
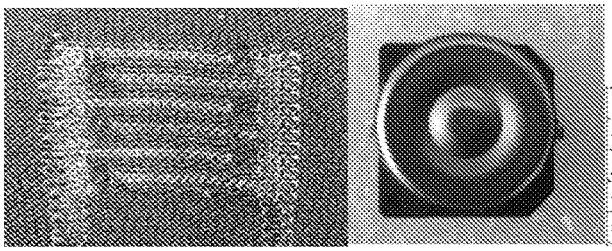
FIG. 9 illustrates a textile supercapacitor (left), a commercial supercapacitor (center), and a table with corresponding charge discharge times and voltages (right).

A DC power supply was used to determine the charge time of both supercapacitors to compare the charge times. FIG. 9 illustrates a textile supercapacitor (left), a commercial supercapacitor (center), and a table with corresponding charge discharge times and voltages (right). As indicated, the commercial supercapacitor charged closer to the DC input voltage in a faster time period than the textile component. However, with optimization of the textile supercapacitor, the charge time and voltage can be improved.

Energy Harvesting Circuit

Efficient rectification circuitry is essential for wireless energy harvesting and is widely discussed in the literature in the context of rectifying antenna (rectenna) applications. The rectification circuit herein described converts the RF energy captured from the fabric antenna into a DC signal that is used to charge a textile supercapacitor. In an exemplary embodiment, two Schottky surface-mount diodes, Avago HSMS8101 and HSMS2860, were examined since their electrical properties make them ideal rectifiers at higher frequencies. The benefit to using this chip design is that it can be inserted and removed from the pocket for washing or replacement without having to cut out small circuit components. Due to its small size, and how the pocket was designed, it is not easily discernable from the front of the fabric, and visually eliminates any evidence of additional solid components.

In an exemplary embodiment, two approaches were considered for connecting the electrical components to the fabric: connecting the components directly to conductive yarns from the textile antenna, or soldering components to a PCB then connecting the PCB to the textile antenna. Connecting the electronics directly to the fabric is challenging due to the physically small size of the rectifying diode and associated components. For this reason, the inventors focused on designing a PCB that may be directly connected into the fabric.

Figure 10:
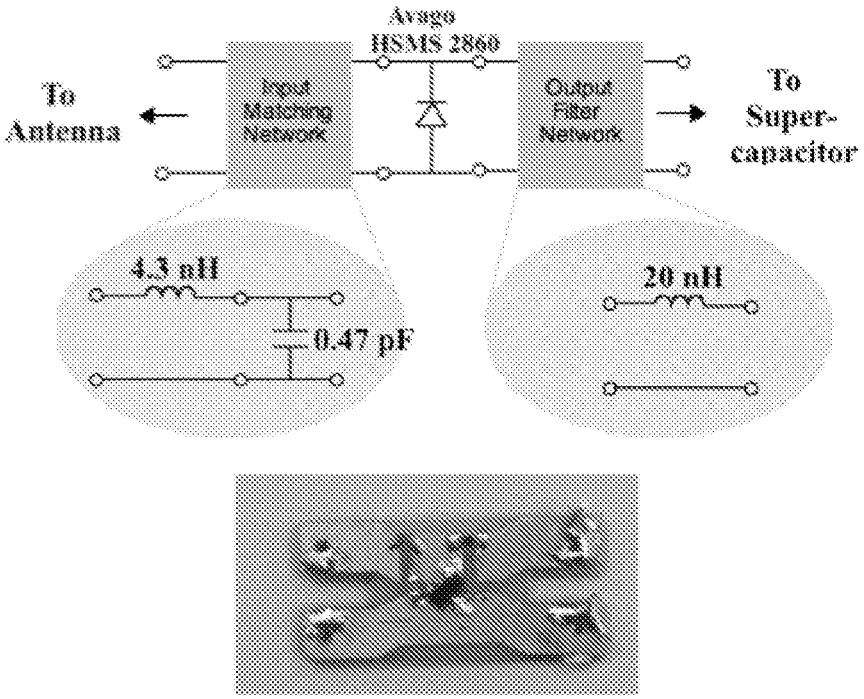
FIG. 10 illustrates an energy harvesting circuit diagram (top) and physical on chip device that can be inserted into a pocket and connected to both the antenna and supercapacitor in an exemplary embodiment.

FIG. 10 illustrates an energy harvesting circuit diagram (top) and physical on chip device that can be inserted into a pocket and connected to both the antenna and supercapacitor in an exemplary embodiment. As illustrated, the circuit includes an input matching network, a Schottky diode, and an output filter network. The input matching provides maximum power transfer between the attached energy source (fabric antenna) and the rectifier. The output filter network prevents RF energy from reaching the DC load, which would cause reduced RF-DC conversion efficiency.

Figure 12:
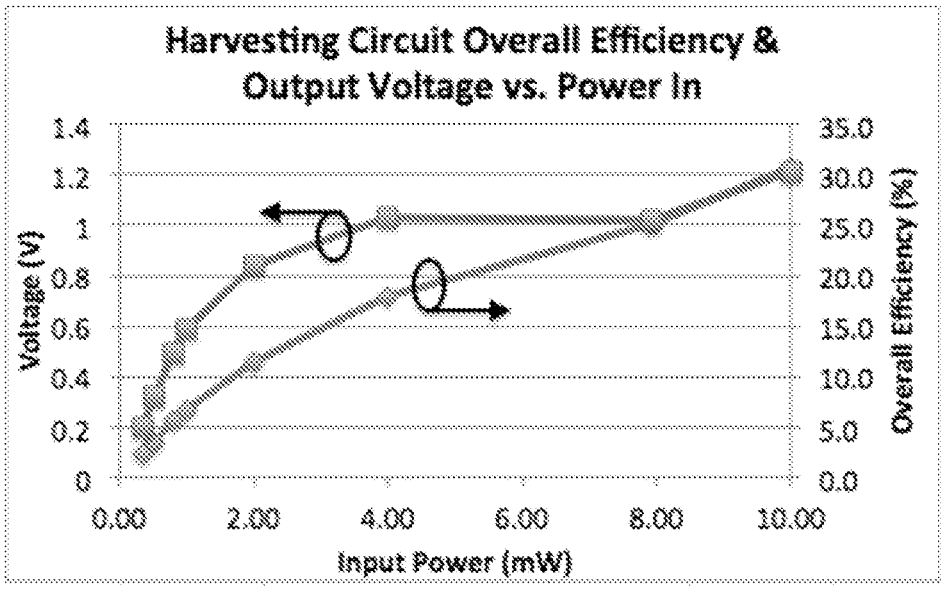
FIG. 12 shows that with increased input power, the device efficiency can be increased for the circuits of FIGS. 10 and 11.

The physical PCB harvesting circuit of FIG. 10 is contained on a 14 mm×11 mm PCB and has been tested by connecting the RF input terminal to a 2.45 GHz source using an edge-mount SMA connector. A load resistance of 500Ω was used for the DC load. As shown in FIG. 12, it is evident that the conversion efficiency increases with increasing input power level, as expected. The output voltage is approximately 600 mV at 1 mW incident received power and the conversion efficiency is 5%.

Figure 11:
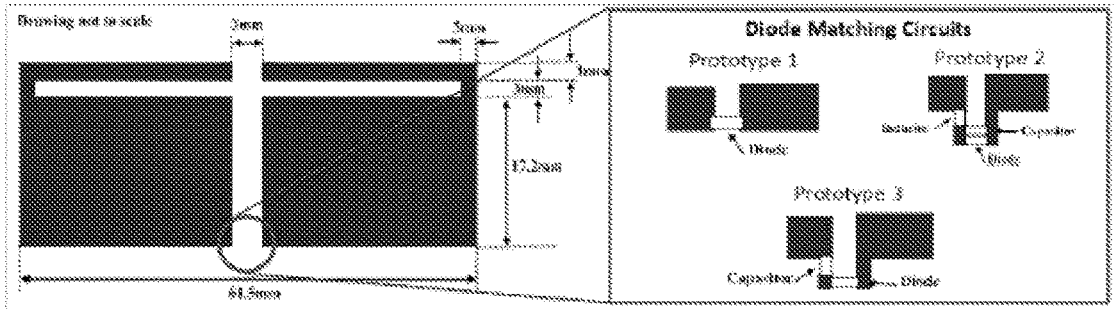
FIG. 11 illustrates diagrams of different diode matching circuits (top) and the corresponding table for each circuit (bottom).

FIG. 11 illustrates diagrams of different diode matching circuits (top) and the corresponding table for each circuit (bottom). Using the Friis Transmission Equation, one can determine the circuit efficiency of each prototype circuit (1-3) based on the operating wavelength (λ), distance between antennas (R), transmitter and receiver antenna gain (Gt, Gr respectively), and transmitted power (Pt). Based on these parameters, one can design the antenna to operate at a specified wavelength, and can be design to have a specified separating distance.

$$P_r = \left(\frac{\lambda}{4\pi R}\right)^2 G_t G_r P_t$$

This formula does not account for the return loss or polarization mismatch of the transmitter and receiver antennas, which are assumed to be negligible.

It will be appreciated that, when using the illustrated circuits, depending on the input power from the antenna, the device will have varying efficiencies and resulting voltages. FIG. 12 illustrates power sweep results for the energy harvesting circuit. As noted above, FIG. 12 shows that with increased input power, the device efficiency can be increased.

Four (4) Fabric-PCB Interconnection Methods

Figure 13:
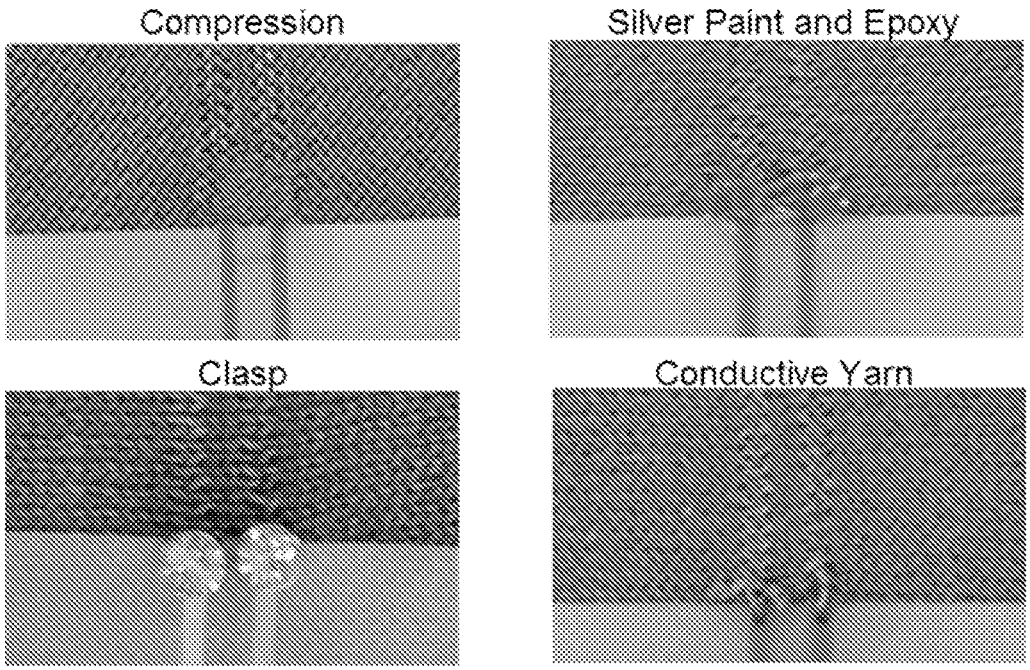
FIG. 13 illustrates various interconnect methods for connecting circuit elements to fabric.

In order to attach the PCB containing the matching network and rectification diode to the conductive fabric, an interconnection method was necessary due to the difficulty of connecting the hard components (inductors, capacitors, and diode) directly to fabric. The connection methods that were examined during testing were as illustrated in FIG. 13 and described below.

Compression—The PCB contains tabs that extend into pockets that provide a compression fit, forming an electrical connection by making contact between the copper of the PCB and the conductive fabric. The compression provides mechanical stability for the PCB.

Clasp—Similar to the compression method, a clasp is used to hold the copper of the PCB to the conductive fabric. Holes are drilled into the board for a mating post (such as an earring) to pass through both the PCB and the conductive fabric material. A clasp (such as an earring backing) is used opposite the mating post to secure the PCB and fabric together. The clasp serves as mechanical support.

Silver paint & epoxy—The next method uses silver paint as the electrical connection while adding a coating of epoxy over the connection for mechanical stability. This uses the same PCB as the compression method with the tabs extending from the board.

Conductive yarn—The final interconnection method utilizes conductive yarn threaded through conductive yarns to sew the board into the fabric. This uses the same PCB as the clasp method. The conductive yarn serves as both a mechanical and electrical connection between the PCB and fabric.

Insertion Loss Testing

Figure 14:
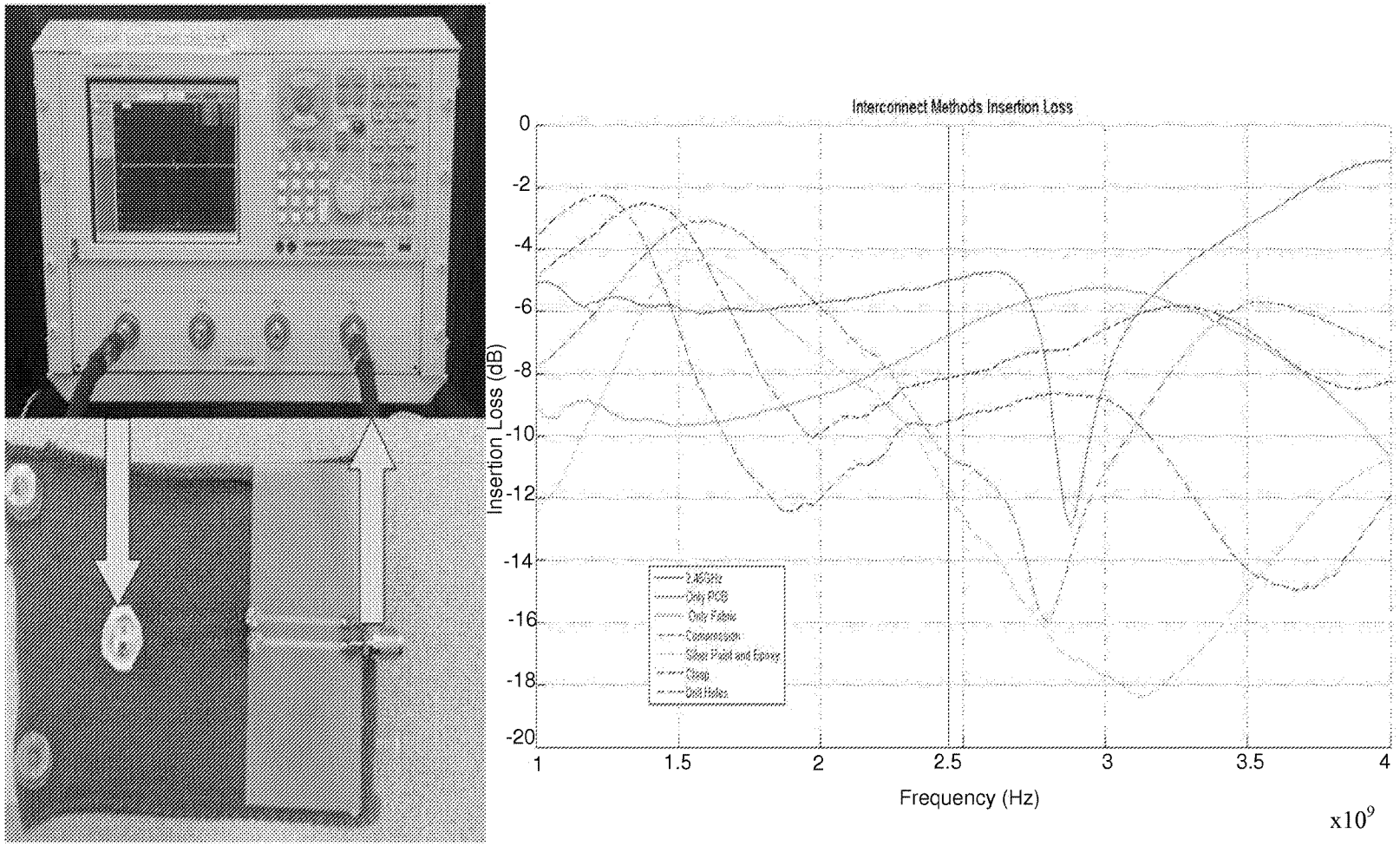
FIG. 14 illustrates return loss testing that characterizes the effect of the interconnection method on the amount of energy the antenna can harvest at the target frequency band (2.41-2.48 GHz).
Figure 15:
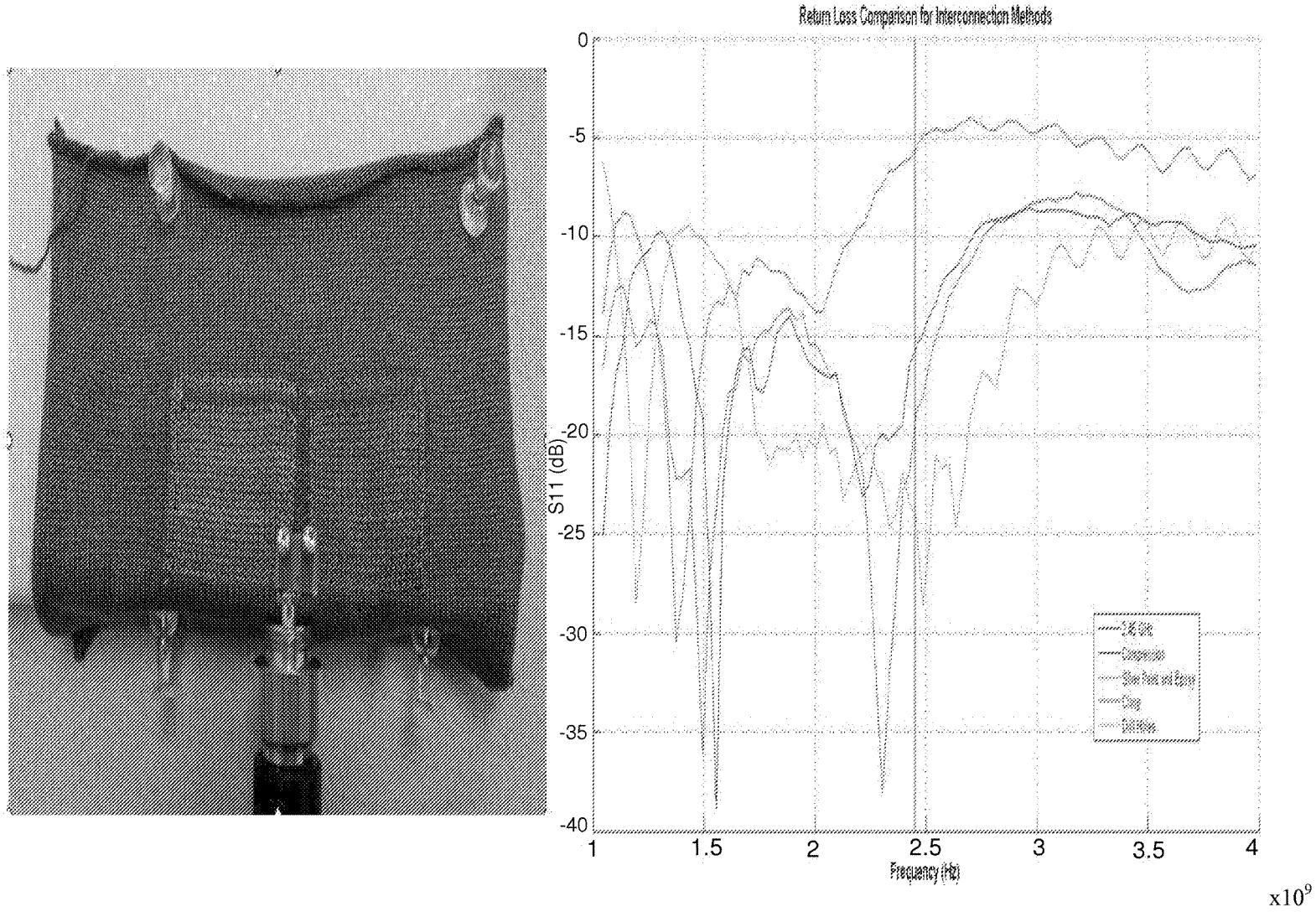
FIG. 15 illustrates radiation pattern testing that characterizes the effect of the interconnection method on the area around the antenna from which it can effectively harvest energy.
Figure 16:
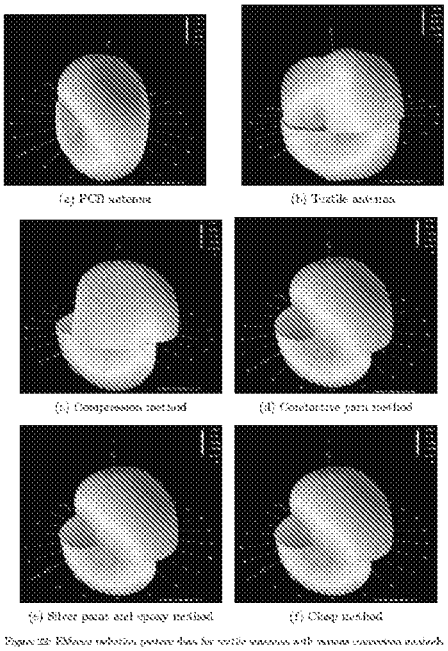
FIG. 16 illustrates the gain, as seen from the plotted gain, and the corresponding table for each interconnect method as tested.

Insertion loss testing characterizes the electrical loss through the interconnection method, where the more power lost through the connection, the less energy is converted and stored in the supercapacitor. As illustrated in FIG. 14, return loss testing characterizes the effect of the interconnection method on the amount of energy the antenna can harvest at the target frequency band (2.41-2.48 GHz). In addition, as illustrated in FIG. 15, radiation pattern testing characterizes the effect of the interconnection method on the area around the antenna from which it can effectively harvest energy. FIG. 16 illustrates the gain, as seen from the plotted gain, and the corresponding table for each interconnect method as tested.

Rectifier Circuit, Lumped Components, Fabric Pockets

Figure 17:
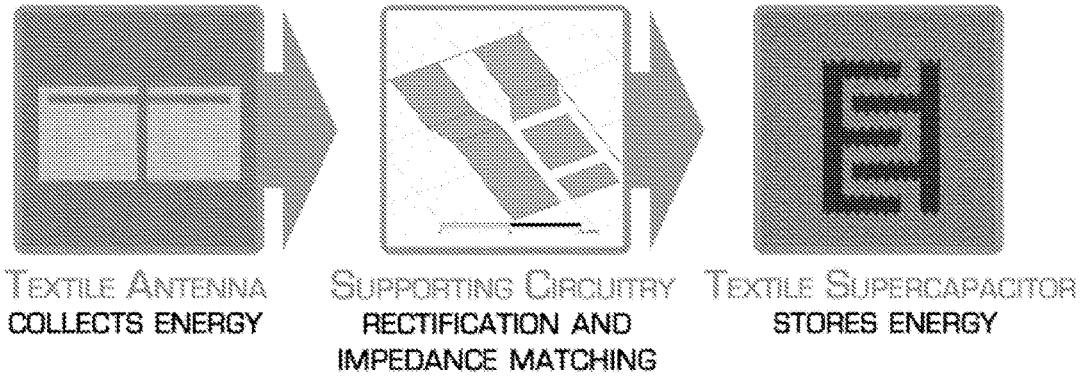
FIG. 17 illustrates the main components of an energy harvesting system in accordance with the invention.

The three main components of the energy harvesting system of the invention are a fully textile antenna, impedance matching and rectification circuitry implemented on a printed circuit board (concealed in a custom pocket), and a fully textile supercapacitor, as shown in FIG. 17. The energy harvesting system will charge a 1 mF supercapacitor to 80 mV in approximately 15 minutes. A highly directional antenna supplied with 100 mW at 2.45 GHz will direct power to the energy harvesting system at a distance of 40 centimeters. Currently the integrated textile energy harvesting system has a form factor of approximately 56 square centimeters, ideal for fitting on the upper back of a garment.

Figure 18:
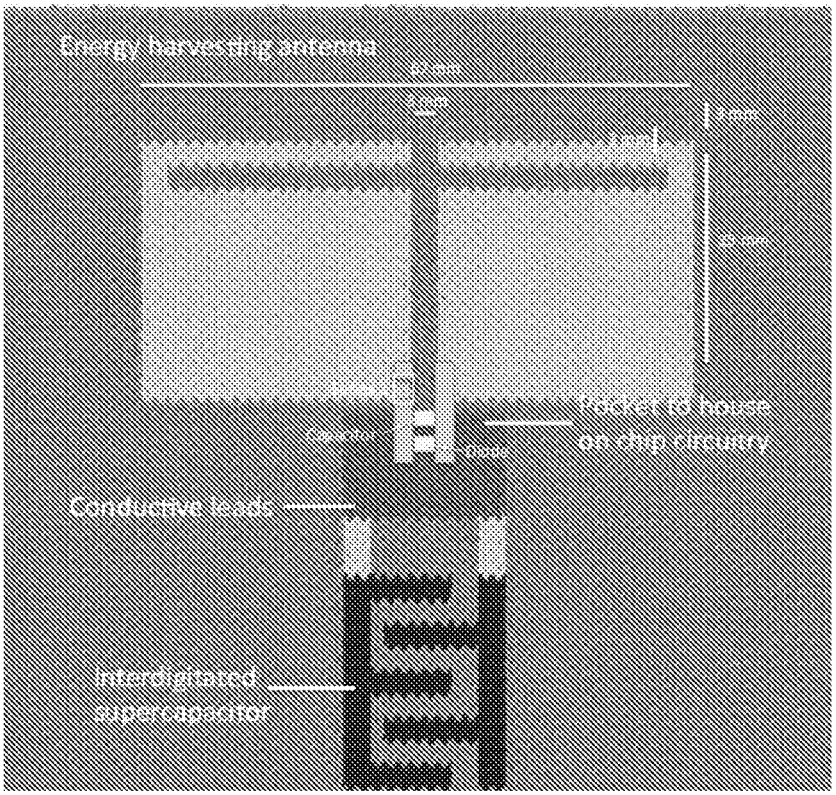
FIG. 18 illustrates a fabric rectenna layout including rectifier circuitry for RF to DC conversion, a pocket to house the on-chip circuitry, and the fabric supercapacitor connected below.

As shown in FIG. 4, the rectenna is made by the main radiation element 406 (folded dipole design) connected to a rectifier circuit 408, which is responsible for converting the RF energy into a DC power. FIG. 18 illustrates the fabric-based antenna layout along with the gaps for including the rectifier circuit. The circuit includes surface-mount inductance (L) and capacitance (C) components for matching the antenna impedance to the Schottky diode HSMS-8101. Alternatively, the antenna input impedance can be directly matched to the diode impedance by altering the antenna dimension and layout, avoiding the need of the L-C matching network. At the diode output the DC power is then transferred to the energy storage unit. These components can be connected to the fabric by using liquid epoxy chemicals, which ensure good electrical connection between the component and the conductive fabric. In order to ensure the components stability while preserving the fabric flexibility, small fabric pockets are knitted to include these surface-mount components.

It is noted that products exist that implement wireless energy harvesting techniques, fabric antennas, or fabric supercapacitors. For example, Powercast Powerharvester is a surface mount integrated circuit (IC) that is powered via a designated high power transmitter. The Powercast IC is comprised of an RF-DC converter, switching control, and power regulation; a dedicated transmitter is provided for high incident and highly reliable power. However, the Powercast IC is implemented on a circuit board rather than on fabric and Powercast uses a non-planar antenna design rather than a low-profile antenna.

Demonstration of Whole Knitted Harvesting System in Fabric

Figure 19:
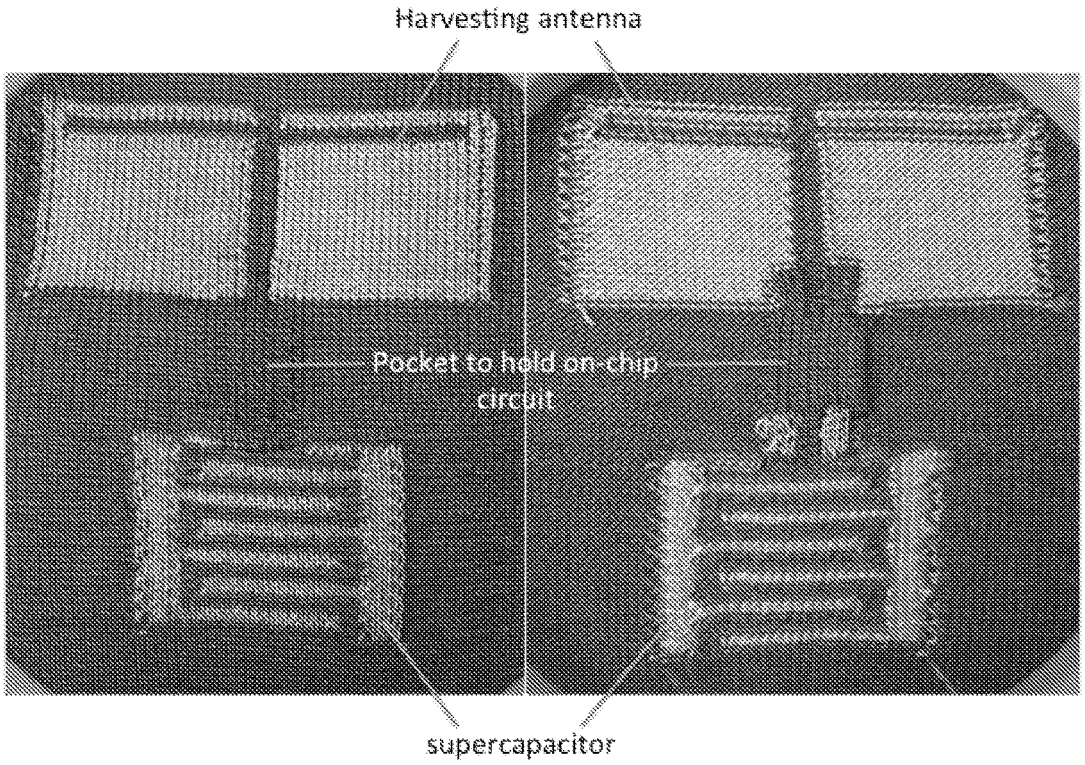
FIG. 19 illustrates on the left side the front of an integrated harvesting and storage system, knitted in silver coated nylon (antenna) and stainless steel (supercapacitor) with an inactive polyester yarn as the base fabric (dark) and on the right side the back of the fabric, illustrating that the pocket opens on the back for chip insertion/removal.

As described above, the design using a rectenna has been successfully knitted along-side a knitted supercapacitor and successfully charged by connecting the in-pocket chip from the antenna to supercapacitor. FIG. 19 illustrates on the left side the front of an integrated harvesting and storage system, knitted in silver coated nylon (antenna) and stainless steel (supercapacitor) with an inactive polyester yarn as the base fabric (dark). A Shima Seiki knitting machine was used to create the fabric. The right side of FIG. 19 illustrates the back of the fabric, illustrating that the pocket opens on the back for chip insertion/removal. This system demonstrates the first time an RF energy harvesting system (antenna, rectification circuitry, and supercapacitor) has been integrated on a single piece of fabric and successfully harvested and stored energy. With a PCB in the pocket containing harvesting circuitry, a textile supercapacitor was charged to 30 mV in 5 minutes using approximately 2 μW of harvested energy.

Array Configuration

Figure 20:
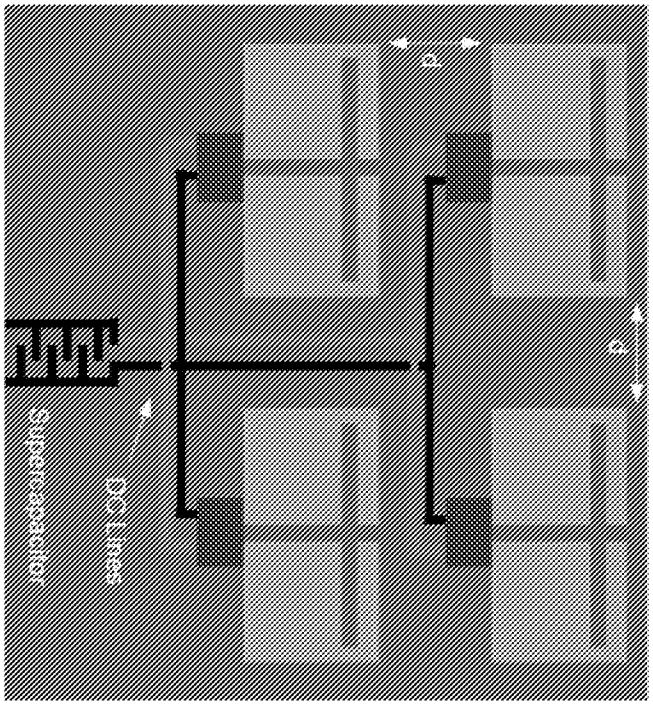
FIG. 20 illustrates a sketch of a rectenna array connected to a single storage supercapacitor.

In order to enhance the amount of harvested power, it is desirable to cascade more than one rectenna adding up each of their energy contributions by adding the DC output voltages of each rectenna. As a result, the higher gain of the whole receiving system will allow for faster charge of the knit supercapacitor. FIG. 20 illustrates an example of 2×2 rectenna array, where the DC output of each rectenna is combined for energy storage in the supercapacitor. The distance "d" between each element can be tuned (in the order of quarter of frequency wavelength) to achieve a more directive radiation pattern and reducing coupling between each antenna. Depending on the desired load, the output of the supercapacitor can be either connected directly to the load or managed through an appropriate voltage regulator connected between the supercapacitor and the load. Of course, a drawback to such an array is increased textile complexity, increased circuit complexity, and an increase in component count.

Power Storage

Those skilled in the art will appreciate that the textile supercapacitor may be knitted using fibers and techniques described in U.S. Provisional Patent Application No. 61/858,358, filed Jul. 25, 2013, and assigned to the present applicant. The disclosure thereof is incorporated herein by reference. In the present embodiments, the textile supercapacitor components include: 1) a current collector made from a commercially available stainless steel yarn (Beakart, Germany), and 2) an electrode made of a conductive high surface area material such as activated carbon, carbon nanotubes, graphene or graphite, a conducting polymer, or oxide material. The current collecting steel yarn preferably has sufficient surface area to store the charge collected by the harvesting antennas. The textile supercapacitor components also include 3) a separator adapted to electrically insulate the electrodes/current collectors from each other, which may include nonconductive yarns knitted between the conductive layers; and 4) an electrolyte that is a polymer gel coated onto the steel yarn either pre- or post-knitting. The electrolyte is composed of polyvinyl alcohol (PVA), phosphoric acid ($H_3PO_4$), water and silicotungstic acid. The polymer is applied and heat treated at 90° C. for 20 minutes to solidify. Other commonly used polymer electrolytes only use PVA, $H_3PO_4$ and water of different ratios.

To charge the device with the harvesting antenna, a physical metallic connection is made, either by soldering wires, or adhering conductive yarns to each other.

Power Management

Exemplary embodiments of the textile supercapacitors described herein are limited to a 1V maximum voltage. Previously, power management circuitry was designed and fabricated on a PCB to boost the harvested voltage from the rectenna to a level that would enable powering of a Bluetooth low energy module. The power management board included an LTC3108 IC, a transformer, and a number of external capacitors. This circuit was initially tested with a power supply to verify functionality and to determine the minimum startup voltage and current required for operation. Testing indicated that the minimum startup voltage was approximately 100 mV at 40 mA, an input power requirement of 4 mW.

The inventors have developed a PCB rectenna prototype capable of providing 80 μW of power. While other methods of increasing the harvested energy and the RF-to-DC conversion efficiency may be used, the inventors decided to bypass the power management and to charge the supercapacitor with the rectenna directly in order to provide a functional, integrated textile energy harvesting system.

Alternate Rectenna Design

Figure 21:
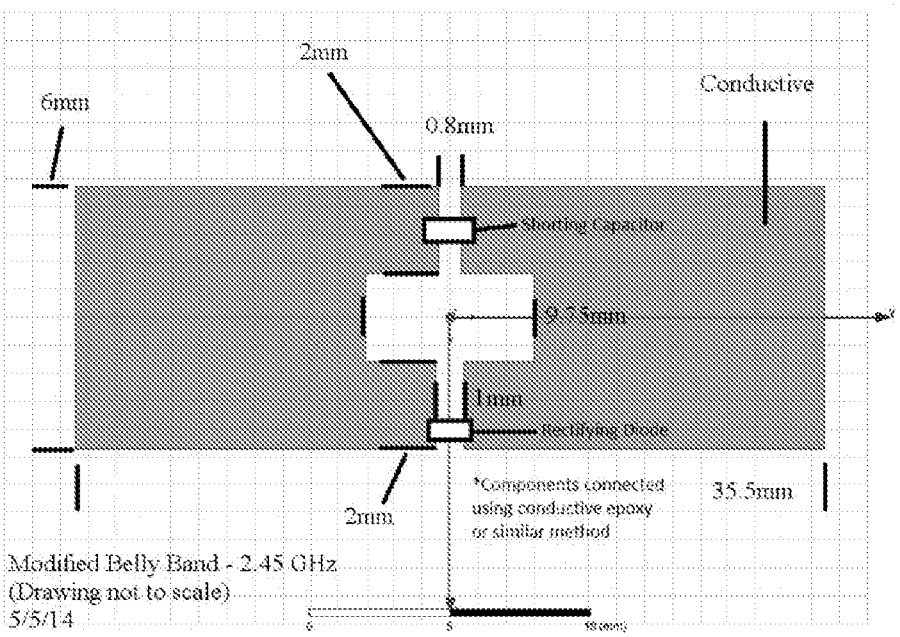
FIG. 21 illustrates a schematic of a rectenna design requiring only a shorting capacitor and rectifying diode to transfer power to the supercapacitor.
Figure 22:
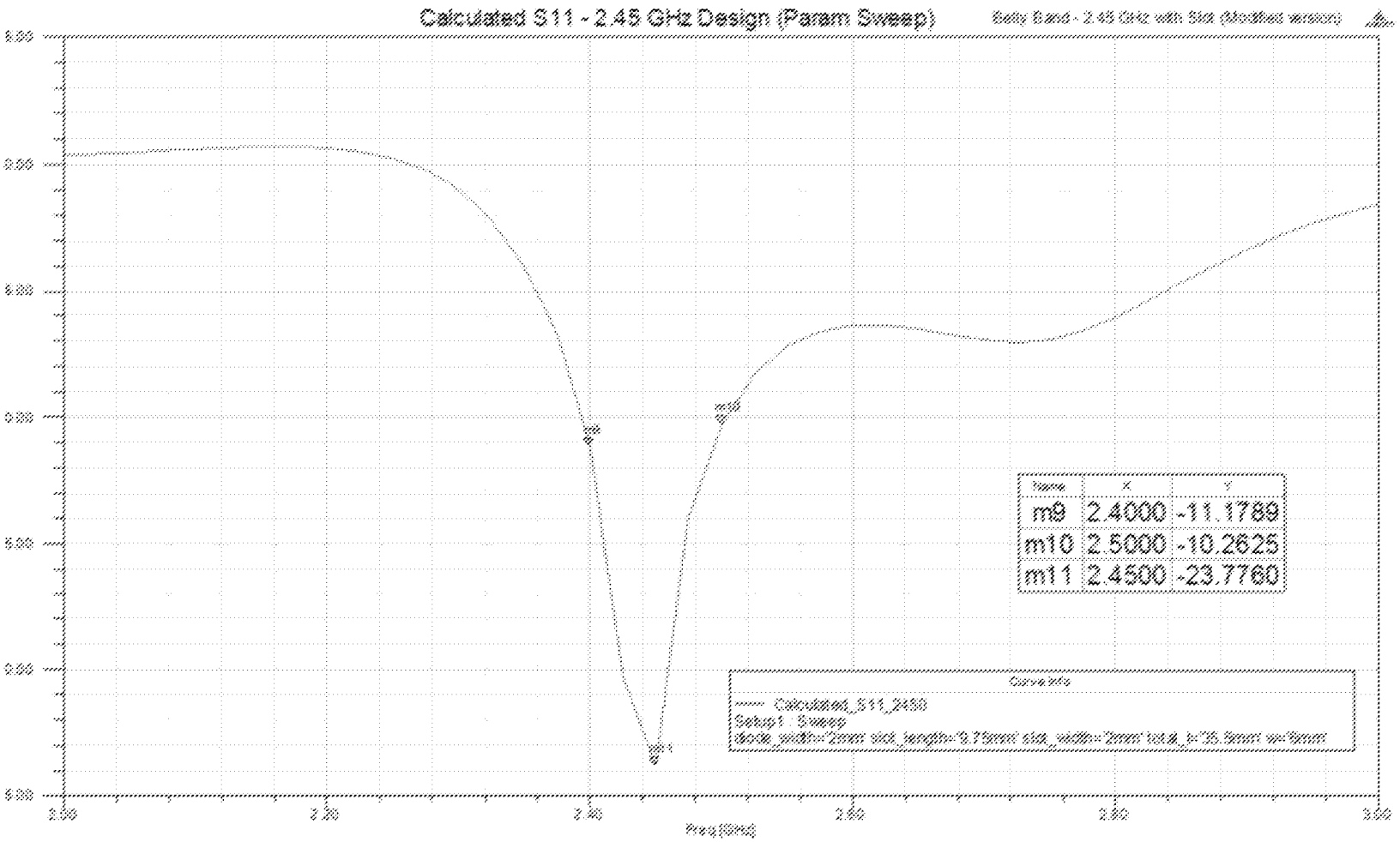
FIG. 22 illustrates a simulated sweep for a 2.45 GHz antenna design having the layout of FIG. 21.

A new rectenna design has been investigated with the goal of implementing an antenna structure that provides more tunability of the input impedance. FIG. 21 illustrates a schematic of a rectenna design requiring only a shorting capacitor and rectifying diode to transfer power to the supercapacitor. This antenna provides a structure with an input impedance that is easily modified by changing the physical dimensions of the antenna. If the input impedance of the antenna is tuned to the complex conjugate impedance of the rectifying diode, this would maximize power transfer from the antenna to the rectifier, improving RF-DC conversion efficiency. The antenna layout in FIG. 21 is in the form of a folder dipole antenna. The lower gap represents an output port that is connected to the diode-based rectifying circuit as illustrated, while the upper gap is design to include the DC-block shorting capacitor as illustrated. The antenna of FIG. 21 is particularly suited for conjugate impedance matching with the majority of rectifying diodes and thus does not need the integration of matching circuits. Also, this impedance matching is accomplished in exemplary embodiments using lumped element capacitors and inductors. By using an antenna design that is impedance matched to the rectifying diode, the need for additional lumped circuit components is eliminated and no on-chip circuit is needed between the antenna and the supercapacitor, thereby decreasing overall system complexity and improving manufacturability. FIG. 22 illustrates a simulated sweep for a 2.45 GHz antenna design having the layout of FIG. 21.

Applications

Applications for the wearable power harvesting system described herein include at least the following:

Powering technology such as Bluetooth, handheld devices, and NFC Wireless charging Powering small biomedical sensors
Powering BLE Bluetooth modules (low power modules)
Powering low power microprocessor units
Charging small batteries or capacitors (e.g., fabric-based supercapacitors)
Charging biomedical sensors
Charging of fitness or entertainment wearable sensors
Charging of wearable military devices Applications of the systems described herein include healthcare monitoring, location tracking, interactive gaming, athletics monitoring, and other wireless applications apparent to those skilled in the art.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

What is claimed:

1. A wearable power harvesting system comprising:

a knitted fabric rectenna including an antenna adapted to receive radio-frequency energy within a desired frequency band;

a rectifier circuit that converts received radio-frequency energy into a DC current and voltage;

a knitted fabric load/storage unit that stores DC power from said rectifier circuit and wherein the antenna of the rectenna comprises a compact wideband folded dipole antenna, and wherein the antenna comprises a single layer and includes a non-conductive fabric surrounded by a conductive fabric.

2. The system of claim 1, wherein the non-conductive fabric forms a "T-shape" within the conductive fabric.

3. The system of claim 1, further comprising a knitted pocket that stores circuitry including a Schottky diode and surface-mount inductance (L) and capacitance (C) components that match an impedance of the antenna to the Schottky diode.

4. The system of claim 3, wherein the circuitry is connected to the knitted fabric by silver paint covered by a coating of a liquid epoxy adapted to provide an electrical connection between the circuitry and the fabric.

5. The system of claim 3, wherein the circuitry contains tabs that extend into pockets of the conductive fabric to provide a compression fit.

6. The system of claim 3, further comprising a clasp adapted to hold the conductive elements of the circuitry in contact with the conductive fabric.

7. The system of claim 3, further comprising conductive yarn threaded through a circuit board containing the circuitry so as to connect the circuit board to the fabric.

8. The system of claim 1, wherein the rectenna is included in an array of interconnected rectennas in which a DC power output of each rectenna is combined for storage in the load/storage unit.

9. The system of claim 8, wherein each rectenna is spaced from each other rectenna so as to achieve a directive radiation pattern and to substantially eliminate coupling between each rectenna.

10. The system of claim 1, wherein the desired frequency band is 2.4 GHz or 5 GHz.

11. The system of claim 1, wherein the knitted fabric load/storage unit comprises a knitted supercapacitor.

12. The system of claim 11, wherein the rectenna includes a shorting capacitor and rectifying diode at an output port to transfer power to the supercapacitor.

13. The system of claim 11, wherein the knitted supercapacitor is interdigitated.

* * * * *